US007839293B2

(12) United States Patent
Jubran

(10) Patent No.: US 7,839,293 B2
(45) Date of Patent: Nov. 23, 2010

(54) SOUND GENERATING DEVICE FOR USE BY PEOPLE WITH DISABILITIES

(76) Inventor: Farah Jubran, 34 Hess st., Apt. #3, Haifa (IL) 33396

( * ) Notice: Subject to any disclaimer, the term of this patent is extended or adjusted under 35 U.S.C. 154(b) by 447 days.

(21) Appl. No.: 11/164,704

(22) Filed: Dec. 2, 2005

(65) Prior Publication Data

US 2007/0241918 A1 Oct. 18, 2007

(51) Int. Cl.
*G08B 21/00* (2006.01)

(52) U.S. Cl. ..... 340/665; 446/397

(58) Field of Classification Search ..... 340/665; 446/397

See application file for complete search history.

(56) References Cited

U.S. PATENT DOCUMENTS

| | | | | | |
|---|---|---|---|---|---|
| 4,245,539 | A * | 1/1981 | Jones | 84/672 |
| 4,279,188 | A * | 7/1981 | Scott | 84/723 |
| 4,630,832 | A * | 12/1986 | Swanson | 273/374 |
| 5,252,772 | A * | 10/1993 | Wright | 84/18 |
| 5,340,942 | A * | 8/1994 | Kunimoto | 84/661 |
| 5,619,005 | A * | 4/1997 | Shibukawa et al. | 84/658 |
| 5,864,083 | A * | 1/1999 | Caren | 84/737 |
| 6,040,539 | A * | 3/2000 | Hiegel | 200/302.1 |
| 6,328,690 | B1 * | 12/2001 | Takami et al. | 600/159 |
| 2002/0084986 | A1 * | 7/2002 | Armstrong | 345/163 |
| 2002/0158838 | A1 * | 10/2002 | Smith et al. | 345/156 |
| 2002/0176327 | A1 * | 11/2002 | Yamada et al. | 369/30.26 |
| 2003/0128109 | A1 * | 7/2003 | Andou et al. | 340/442 |
| 2004/0056779 | A1 * | 3/2004 | Rast | 340/985 |
| 2004/0061682 | A1 * | 4/2004 | Landfried | 345/163 |
| 2004/0074380 | A1 * | 4/2004 | Fishman | 84/741 |
| 2004/0156523 | A1 * | 8/2004 | Tuason et al. | 381/386 |
| 2004/0174256 | A1 * | 9/2004 | Hershkovitz et al. | 340/506 |
| 2005/0026688 | A1 * | 2/2005 | Goeben | 463/36 |
| 2006/0232430 | A1 * | 10/2006 | Takaoka et al. | 340/575 |
| 2006/0274042 | A1 * | 12/2006 | Krah et al. | 345/163 |

FOREIGN PATENT DOCUMENTS

| | | | |
|---|---|---|---|
| CN | 1452154 | * | 10/2003 |
| CN | 1452154 A | * | 10/2003 |
| JP | 09198183 A | * | 7/1997 |

* cited by examiner

*Primary Examiner*—Davetta W Goins
*Assistant Examiner*—Ojiako Nwugo
(74) *Attorney, Agent, or Firm*—William H. Dippert; Eckert Seamans Cherin & Mellott, LLC

(57) ABSTRACT

The invention disclosed herein describes a device allowing even people with severe disabilities (physical and/or mental) to control the generation of sound and music, using controls adapted to their capabilities. The device is to be used primarily in therapeutic, educational and training contexts. The device comprises of pressure-sensitive controls, a programmable control device and a sound/music output mechanism.

24 Claims, 4 Drawing Sheets

SOUND GENERATING DEVICE FOR USE BY PEOPLE WITH DISABILITIES

FIELD OF THE INVENTION

The present invention relates to devices used in a therapeutic, educational and training contexts, allowing even people with severe disabilities (physical and/or mental) to control the generation of sound and music, using controls adapted to their capabilities.

BACKGROUND OF THE INVENTION

Musical instrument have long been used in the interaction of people with disabilities (physical, mental and both). They are known to have a wide range of therapeutic, training and communication-skill uses. Of particular interest is the interaction, therapeutic and communication-building progress made through music therapy with autistic children.

Unfortunately, the same disabilities requiring the treatment, severely hinder the subject's ability to control the sound/music generating instrument, as traditional music instruments require a high degree of physical control and dexterity.

It is an object of the present invention to provide a controlled musical device adapted for fine motor skills therapy, communication therapy, sensory integration, coordination, rehabilitation of palm and other body parts and other music-related training activities.

OVERVIEW OF THE INVENTION

The invention disclosed herein is a sound-generation device adapted to the use of people with disabilities. It is comprised of three main components:

(a) One or more force sensors, though which the user may control the sound generated. The force sensor may be a lateral force sensor (to sense a sideways push with the head, mouth, feet, etc), a pressure sensor (such as a ball squeezed by the hand), an air-pressure sensor (a tube through which the user blows air), a microphone, etc. When the force sensor is a pressure sensor, it is often surrounded by a sponge-like material (such as ball of polyurethane).

(b) A control device, connected to the force sensor(s) and to the speaker(s). Based on the current program selected, the device may interpret force as pitch, tempo or other similar control of the music. As this device is to be used by, people with disabilities, additional controls exist to adjust the response to the sensors to the user's capabilities (such as the range of grip pressures he is capable of applying). In some embodiments the control device may be dedicated device, and in some a personal computer.

(c) Speaker(s)—Internal or external, connected via a "sound out" connector, as is standard in current personal computers.

BRIEF DESCRIPTION OF THE FIGURES

In order to better understand the present invention and appreciate its practical applications, the following Figures are attached and referenced herein. Like components are denoted by like reference numerals.

It should be noted that the figures are given as examples and preferred embodiments only and in no way limit the scope of the present invention as defined in the appending Description and Claims.

DETAILED DESCRIPTION OF THE INVENTION AND FIGURES

Figure 1:
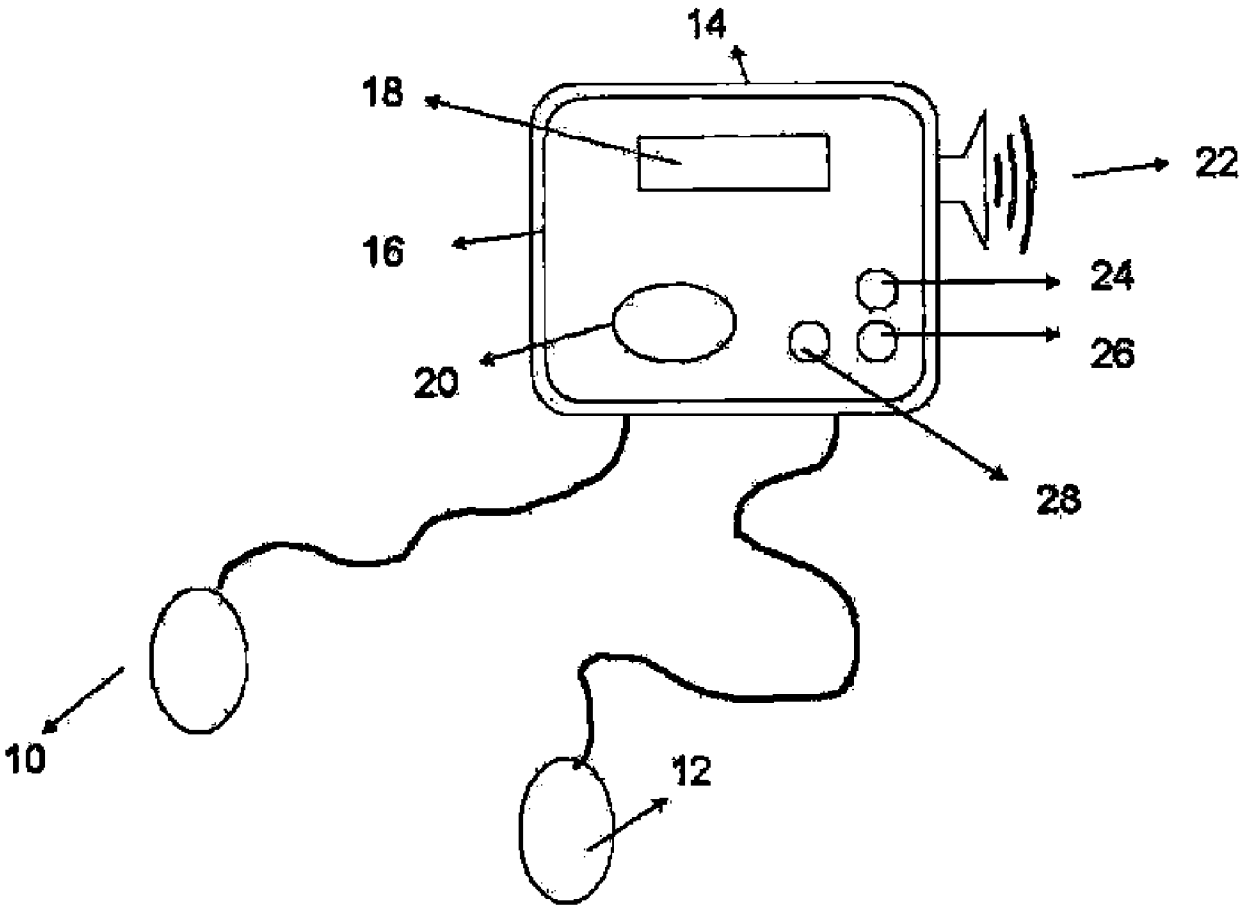
FIG. 1 illustrates a force controlled sound device, with the force sensor implemented as a grip pressure sensor, in accordance with a preferred embodiment of the present invention.

Reference is now made to FIG. 1 illustrating a sound/music generating device, controlled by specialized pressure controllers, in accordance with a preferred embodiment of the present invention. Note the following components (a) Electronic control device (FIG. 1, element 14). Depending on embodiment, this may be either a dedicated device or a personal computer.

(b) Control devices adapted to people with disabilities. In this embodiment force sensors, in the form of grip-pressure sensors, surrounded by a ball of sponge-like material (FIG. 1, elements 10,12). In additional embodiments of the present invention, the control device(s) may be connected using a wireless connection.

(c) Speaker(s) (FIG. 1, element 22) or in a different embodiment of the invention, connection to speakers external to the device.

In this preferred embodiments pressure sensitive balls 10 and 12 are electrically connected to an electronic device 14 provided with a controller 16 wherein the controller is adapted to translate the pressure that is applied onto the sensors to pitch and dynamics that will be established and controlled through the controller.

In a further embodiment, sensors may be other type of force sensors adapted to use by other body parts, such as mouth, leg, etc, depending on the body part of which the user has some measure of control. In such cases the sensors may be sensitive to lateral force, airflow (a tube through which the user may apply an outward (blowing) or inward (sucking) pressure), a microphone, etc—again depending on the physical capabilities of the patient.

A program screen 18 is provided so as to allow visual observation of current operating parameters. Dial 20 may be used to control said parameters, specifically which "program" to execute. Depending on type of program the device may generate different sounds in response to the force applied to the force sensors. For example, sounds may include different instruments, musical patterns, human voices, bird calls, etc.

Further control of the program may define how the force-sensor controllers will influence the sound generated. Effects may include:

(a) Continuous pitch change.

(b) On musical scale pitch change.

(c) On chromatic music scale (½ tone steps).

(d) Playing a sound, voice (verbal reaction), tune or music.

(e) Playing a sound/music only when the same level of force is applied to both right and left grip force sensors (f) Turning on or off, or changing richness, liveliness or volume of, or alternating instrument (envelope) used for playing of, pre-programmed musical scores or sounds using the sensors as multi level switches that change state with applied level of force.

(g) Playing different human-like sounds of male, female, child or choir to form a "dialog" between right and left grip force sensors.

(h) Playing different sounds that relate to human feelings, like laughter, crying or shouting.

(i) Some/all of the above with different sounds or instruments sounds.

Different programs may be useful for different purposes, such as:

(a) Free improvisation/playing.

(b) Exercising bilateral coordination of right and left hands.

(c) Exercising control over force applied.

(d) Musical dialog between two or more users each holding a grip force sensor.

A speaker 22 is provided and optionally headphone plug and/or audio connection to external speakers.

On/off and volume knob 24 are provided wherein the volume knob may be separated of the on/off option.

Dials 26 and 28 allows the device to be adjusted to patient-specific motor skills. Specifically, dial 26 allows adjusting of the force dynamic-range and sensitivity of the pressure gauges in balls 10 and 12, to fit a wide range of gripping strengths. Thus, the device can be adjusted so that a patient with better grip control can enjoy more distinct "force levels" that the sensor can identify and the sensor becomes more sensitive to slight changes in applied force. Dial 28 adjusts the time-response sensitivity of the device by adjusting the sensor's sampling rate (time between every two consecutive grip force samples). Thus, the device can be adjusted so that for a patient with better coordination and reflexes the sensor becomes more responsive and more sensitive to abrupt changes in applied pressure. In certain embodiments of the current invention, such controls may be provided on a per-sensor basis.

Note that the physical controls described above (dials 20, 24, 26 and 28) are for illustrative purposes only, and that the same measure and type of functional control may be implemented by alternate physical means (such as a keyboard and mouse, if the controlling device is a personal computer.

As mentioned herein, the needs of such a musical instrument are various. As an example, the device can be used for fine motor skills therapy for challenged children with different limitations. The child can use all of his fingers or one by one according to his limitation so as to obtain different reaction from the instrument. The device can be also used for music and musical training wherein the user trains his hearing and fine motor skills as well as reaction. Recording studios can use such a device for music and effects. Another example is emotional art therapy.

The force controlled device comprises at least one force sensor but preferably two force sensors—a first pressure sensitive ball 10 and a second first pressure sensitive ball 12. Balls 10 and 12 are hand held elastic balls that are preferably resilient members adapted to change their volume according to the applied pressure. The balls act as pressure sensors.

The pressure sensors can be made, as an example, of sponge-like material that changes its resistance or electrical characteristics according to the pressure. There are several sponges that are available and have characteristics that can be adopted for the scope of the present invention. As an example, a material that changes its resistance is described by Farhad Reza et al. in Journal of Materials in Civil Engineering 15(5), 476-483 (2003), "Resistance changes during compression of carbon fiber cement composites". Another example of a resilient material that is appropriate for this use is described by Gilev S. D. "Electrical properties of a highly porous nickel sponge in a shock wave" in Zhurnal Tecknicheskoi Fiziki 65(6), 84-93 (1995). Other materials adapted to act as pressure sensors can be used or developed specifically for the purpose of the musical instrument of the present invention.

In another embodiment, the pressure sensors can be made of an air bag provided with an electronic pressure sensor.

In another embodiment of the present invention the sensors can be made of a force sensitive resistors (FSR) padded with a resilient material to form the desired shape.

It is preferable that the sensors as shown herein form a full music instrument function. In the embodiment of the system having two sensors the one is preferably configured to perform the function of pitch control (as does the left hand on a guitar) and the other controls the dynamics (as does the right hand, picking the strings on the guitar).

Alternatively, both sensors may be configured as pitch controlled sensors that play different sounds or instruments. In this case, the dynamics can be fixed.

The two sensors shown herein are solely shown as an example. The musical instrument of the present invention can be programmed so that only one sensor is activated or several sensors are activated while each sensor represent a different musical instrument or sound, a pitch or dynamics, etc.

As mentioned herein before, there are several needs for the musical instrument of the present invention, for example—musical and tempo training or therapeutic needs. The characteristic of the sensor from which it is made of could be changes in accordance with those needs. Examples of characteristics that can be tuned in order to design the musical instrument to the specific needs are the elastic coefficient of the sponge, its size, the memory of the sponge (the period of time in which it retains its compacted shape/the rate in which it expands back to its relaxed form), and the material it is made of. Note that the word "sponge" above (and elsewhere) does not strictly refer to the marine creature, but to a wide range of resilient porous materials.

Figure 2:
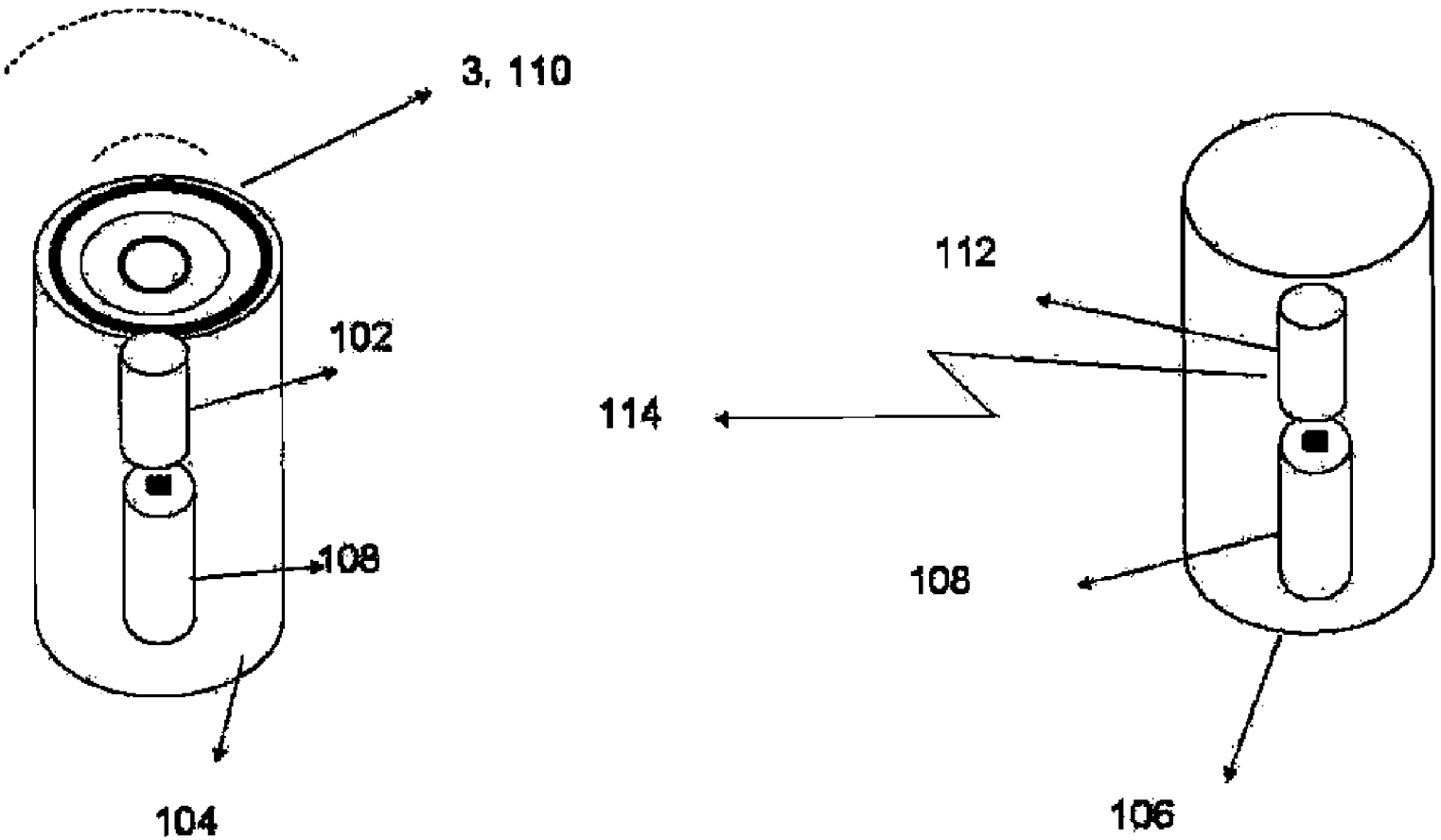
FIG. 2 illustrates a grip pressure controlled sound device in accordance with another preferred embodiment of the present invention.

Reference is now made to FIG. 2 illustrating a pressure controlled sound device in accordance with another preferred embodiment of the present invention.

In certain manifestations of the divulged invention, electronic parts can be incorporated in the resilient matter of which the force sensors are made, allowing the balls to measure force internally and communicate its value wirelessly to the controlling device.

The shape of the force sensor, and the shape of its surrounding material may be adapted to the type of force applied. For example, to allow lateral grip force sensing, the sensors may be shaped as cylinders.

Sound device 100 comprises two cylindrical shaped pressure sensors that are principally similar to the balls in the previous embodiment. A controller 102 is embedded in a fist cylinder 104 and is adapted to translate the pressure that is applied onto the cylinders into pitch through cylinder 104 and into dynamics through a second cylinder 106. Both cylinders are provided with a battery 108 so as to supply electricity to the controller and other components that may use electricity so as to act.

Cylinder 104 is provided with a speaker 110 through which music is sounded. Since the communication between the cylinders 104 and 106 is wireless so as to allow freedom of hands while using theme cylinder 106 is provided with a transmitter 112 adapted to transmit data regarding the pressure that is being applied onto the device and cylinder 104 is provided with a receiver 114 that is adapted to receive the data from transmitter 112. Controller 102 is adapted to receive the data from both cylinders. It should be noted that cylinder 102 can be provided with an on/off knob, program screen and other features that allow communication of the user with the controller.

Figure 3:
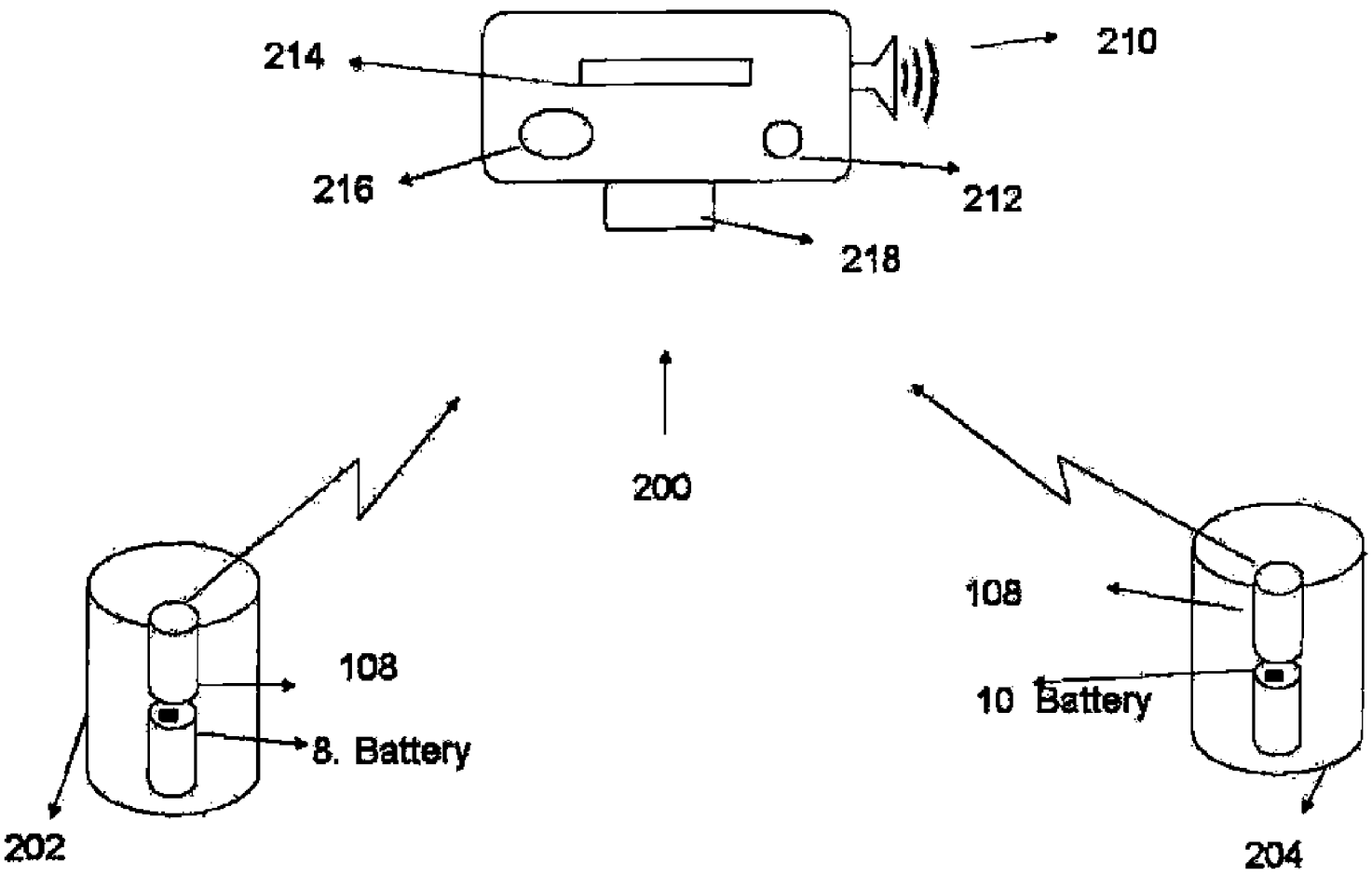
FIG. 3 illustrates a grip pressure controlled sound device in accordance with yet another preferred embodiment of the present invention.

Reference is now made to FIG. 3 illustrating a force controlled sound device in accordance with yet another preferred embodiment of the present invention. In this exemplary embodiment, controller 200 is a stand alone unit that is provided with wireless communication to a first cylinder 202 and second cylinder 204 that are principally similar to the balls in the first embodiment shown in FIG. 1; however, both cylinders are provided with transmitters 108 that are adapted to transmit the pressure data to controller 200. Controller 200 comprises a speaker 210 and optionally headphone plug or audio out. Controller 200 is further provided with on/off and volume knob 212, a program screen 214 and programming button 216. For the wireless communication with the cylinders, controller 200 is further provided with a receiver 218.

Figure 4:
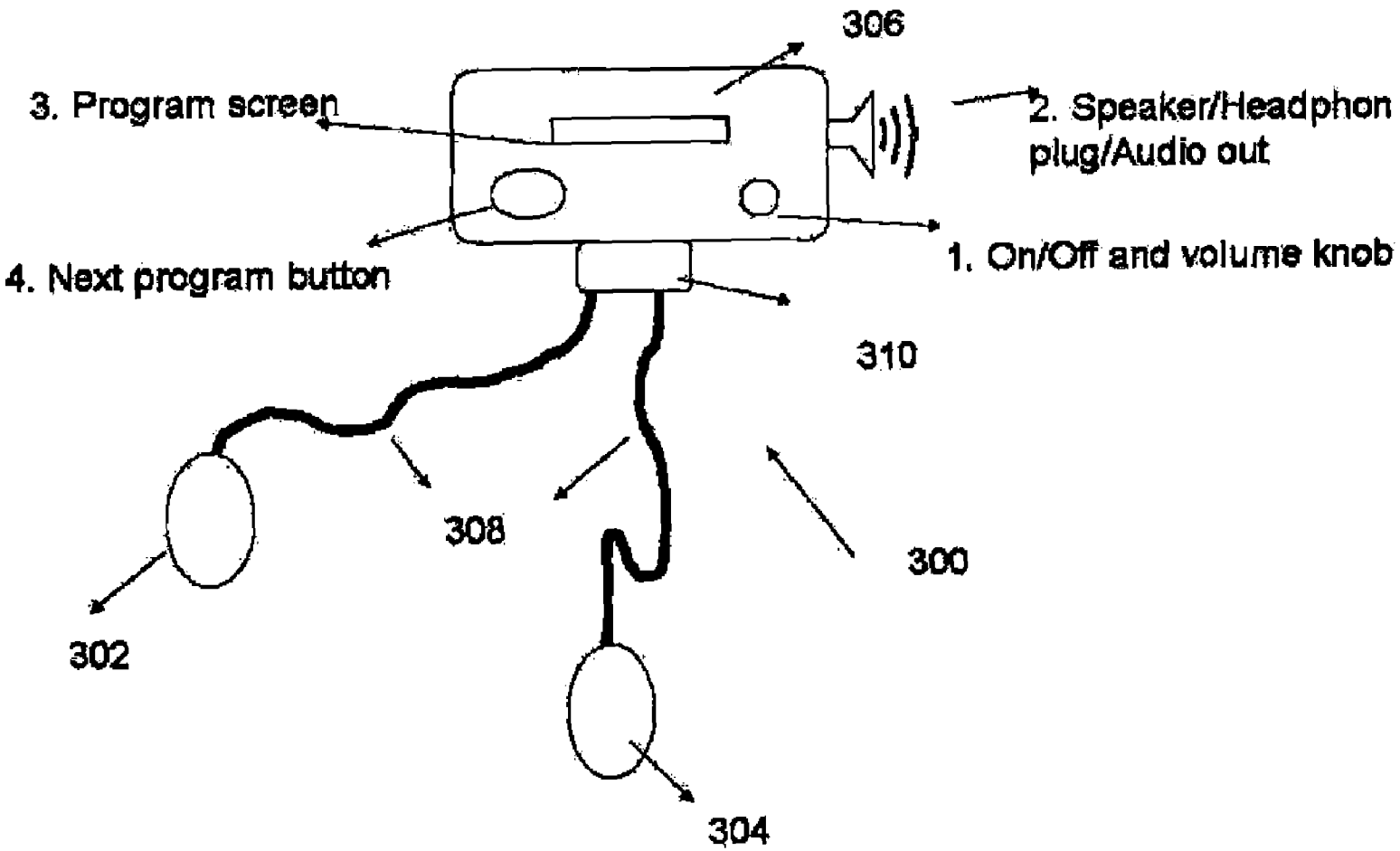
FIG. 4 illustrates a grip pressure controlled sound device in accordance with an additional preferred embodiment of the present invention.

Reference is now made to FIG. 4 illustrating a pressure controlled sound device in accordance with an additional preferred embodiment of the present invention. As mentioned herein before, the pressure sensor can be actuated in another manner. In accordance, force controlled sound device 300 is provided with balls 302 and 304 that have similar objective as balls 102 and 104; however in this embodiment, air bags are being provided within the sensors. The transmission of the information from the balls to a controller 306 is being performed through air pipes 308 that aerodynamically connect balls 302 and 304 to controller 308 through an air pressure sensor 310. Other features of the controller are similar to the features in the embodiments shown herein before.

In another possible embodiment the air pipes 308 could be replaced with a wireless connection that communicates the air pressure.

It should be emphasized that the sensors can be designed in any shape other than a ball or a cylinder. It can be shaped as a toy, for example, when the device is adapted for treatment of disabled children.

It should be clear that the description of the embodiments and attached Figures set forth in this specification serves only for a better understanding of the invention, without limiting its scope as covered by the following Claims.

It should also be clear that a person skilled in the art, after reading the present specification can make adjustments or amendments to the attached. Figures and above described embodiments that would still be covered by the following Claims.

What is claimed is:

1. A controlled sound device comprising:

at least one force sensor capable of continuously sensing dynamic changes in applied force;

a controller electrically connected to said at least one force sensor wherein said controller is capable of real time translating said dynamic changes in applied force to changes in pitch; and at least one speaker for generating sound in accordance with said changes in pitch, wherein said changes in pitch are adapted to the user capabilities and needs.

2. The controlled sound device as claimed in claim 1, wherein said at least one force sensor is enclosed in a resilient member.

3. The controlled sound device as claimed in claim 2, wherein said resilient member is a resilient material having changeable electric resistance or capacitance.

4. The controlled sound device as claimed in claim 2, wherein said resilient member is made of a material selected from a group of materials consisting of foam, sponge, silicone, highly porous nickel composite, flexible material coated with conductive polymers, and flexible material coated with the conductive polymer Pyrole.

5. The controlled sound device as claimed in claim 2, wherein said controller and said at least one speaker are embedded in said resilient member.

6. The controlled sound device as claimed in claim 1, wherein said at least one force sensor is a pressure sensor.

7. The controlled sound device as claimed in claim 1, wherein said at least one force sensor is a force sensitive resistor padded with electrical insulating resilient material.

8. The controlled sound device as claimed in claim 1, wherein said controller is wirelessly connected to said at least one force sensor.

9. The controlled sound device as claimed in claim 1, wherein said controller is capable of further translating said dynamic changes in applied force to changes in music dynamics selected from a group of music dynamics consisting of volume, timing, and tempo.

10. The controlled sound device as claimed in claim 1, wherein said changes in pitch are in instrument or musical score.

11. The controlled sound device as claimed in claim 1, wherein said controller is a personal computer.

12. The controlled sound device as claimed in claim 1, wherein said at least one speaker for generating sound is capable of outputting several different sounds.

13. The controlled sound device as claimed in claim 12, wherein said several different sounds are indicated by use of one or more control dials.

14. The controlled sound device as claimed in claim 1, further comprising a program screen capable of visually illustrating several different images.

15. The controlled sound device as claimed in claim 1, further comprising at least one dial capable of adapting the dynamic force range of said at least one force sensor.

16. The controlled sound device as claimed in claim 15, wherein said at least one dial is suitable for adapting the timing response of the controlled sound device.

17. The controlled sound device as claimed in claim 15, wherein said at least one dial is suitable for adjusting the dynamic force range and sensitivity of pressure gauges to fit a wide range of gripping strengths.

18. The controlled sound device as claimed in claim 1, wherein said adapting the timing response comprising changing the sampling rate of said continuous changes in applied force on said at least one force sensor.

19. The controlled sound device as claimed in claim 1, wherein said at least one force sensor is operated by a part of a user's body of which the user has some degree of control.

20. The controlled sound device as claimed in claim 19, wherein said part of a user's body is a hand.

21. The controlled sound device as claimed in claim 19, wherein said at least one force sensor is operated by inhalation and exhalation.

22. The controlled sound device as claimed in claim 1, wherein the adapting the timing response of the controlled sound device is in accordance with pace or usage goals of the user.

23. The controlled sound device as claimed in claim 1, further comprising at least one dial capable of adjusting the sensitivity of said at least one force sensor.

24. The controlled sound device as claimed in claim 23, wherein said adjusting the sensitivity of said at least one force sensor is quantizing the number of levels of the dynamic force range.

* * * * *